US006592187B2

(12) United States Patent
Calvery

(10) Patent No.: US 6,592,187 B2
(45) Date of Patent: Jul. 15, 2003

(54) MULTIUSE PORTABLE CHAIR

(76) Inventor: Andrew L. Calvery, 17051 SE. 272nd, Suite 43, Box 222, Renton, WA (US) 98042

( * ) Notice: Subject to any disclaimer, the term of this patent is extended or adjusted under 35 U.S.C. 154(b) by 0 days.

(21) Appl. No.: 09/681,798

(22) Filed: Sep. 28, 2001

(65) Prior Publication Data

US 2003/0062757 A1 Apr. 3, 2003

(51) Int. Cl.[7] ..... A47C 15/00
(52) U.S. Cl. ..... 297/352; 297/252
(58) Field of Search ..... 297/352, 252, 297/250.1, 219.1, 219.12, 217.7, 134, 16.2, 440.1, 440.15, 440.2, 440.21, 440.22, 440.24, 24, 25, 29

(56) References Cited

U.S. PATENT DOCUMENTS 816,545 A * 3/1906 Field
849,451 A * 4/1907 Zane
1,293,592 A * 2/1919 Wilber et al.
1,461,772 A * 7/1923 Fuller
1,515,564 A * 11/1924 Field
2,545,840 A * 3/1951 Browne
3,026,142 A * 3/1962 Holloway
3,066,980 A * 12/1962 Clute
3,987,807 A * 10/1976 Varnell
4,045,834 A * 9/1977 Mason
5,498,054 A * 3/1996 Tomlinson

* cited by examiner

*Primary Examiner*—Peter M. Cuomo
*Assistant Examiner*—Stephen Vu
(74) *Attorney, Agent, or Firm*—David L. Tingey

(57) ABSTRACT

A portable multipurpose chair provides hooks on a frame that can be hooked around a bleacher seat or alternatively be used as legs of the chair in outdoor environments such as a beach or campsite. Telescoping frame sides include an elastic cord to bias the hooks together to remain engaged around a bench seat when the chair is used in a bleacher environment. The back of the seat includes a backrest against which a user can lean. Rigid cross members ensure that the chair remains in a stable position when in use.

10 Claims, 2 Drawing Sheets

MULTIUSE PORTABLE CHAIR

BACKGROUND OF THE INVENTION

The present invention relates to a multiuse recreational chair that can be used in a variety of situations and environments. Generally, these chairs have been made of lightweight materials and are often collapsible to enhance the portable nature of this type of chair. One existing problem with these chairs, however, is that they are not adaptable to many different outdoor environments. One situation, in particular, that has not been well addressed by current chairs on the market is a suitable chair to be used with bleachers at ball parks, stadiums and other outdoor arenas.

One example of a chair that attempts to address the bleacher seat problem is disclosed within the U.S. Pat. No. 4,045,834 to Mason. The chair disclosed by Mason is adapted for use on a conventional bleacher seat having a single plank as a bench. These bench-type seats are often uncomfortable due to the fact that they have no back rest on which a person can lean. Mason attempts to resolve this problem by using an attachment to the bench that hooks around the plank and provides a flexible back to lean back upon.

The bleacher attachment of Mason suffers from several disadvantages. The first is that the construction of Mason's backrest causes the uprights of the backrest to collapse inwardly toward a person's body when he leans back upon the flexible backing. The collapse of the back rest defeats the major purpose of the device, which is to improve the comfort of a conventional bench seat. Another disadvantage of Mason's device is that it does nothing to improve a person's comfort relative to the bench seat. Bench seats are often hard and can collect and retain moisture making the seats very uncomfortable. With Mason's device, it would be necessary to carry an additional seat cushion or a sheet of waterproof material to make the bench more comfortable. A further disadvantage of Mason's device is that it is made for a single purpose, specifically as a backrest for bench seats, and cannot be adapted for other outdoor or recreational uses.

SUMMARY OF INVENTION

It is an object of this invention to provide a chair that can be adapted for use with a bleacher-type seat that allows a person to lean back upon a back rest and have a layer of material over the bench to provide further comfort to the user. Another object the invention is to provide a chair that is adaptable to a variety of environments and recreational situations. It is a further object of the invention to provide a chair that is simple in design and manufacture, collapsible for easy portability of the device, and sturdy in construction to withstand a variety of conditions. Other objects of the invention will be apparent hereinafter from the specification and from the recital of the appended claims, particularly when read in conjunction with the accompany drawings.

The present invention comprises a chair having a backrest hinged or otherwise attached, evenly removably attached, to a seat portion. The seat portion includes telescoping members on either side of a sheet of material attached between the telescoping supports. The supports include hook members that can be hooked around a bleacher seat or alternatively be used as legs of the chair in outdoor environments such as a beach or campsite. The telescoped supports include a spring bias to force the hooks to remain hooked around a bench seat when the chair is used in a bleacher environment. The back of the seat includes a backrest against which a user can lean to allow further comfort. Rigid cross supports are provided to ensure that the chair remains in a stable position when in use. The hinge between the back and seat portions allow the device to collapse onto substantially a single plane to allow the seat to be easily carried and stored.

DETAILED DESCRIPTION

Figure 1:
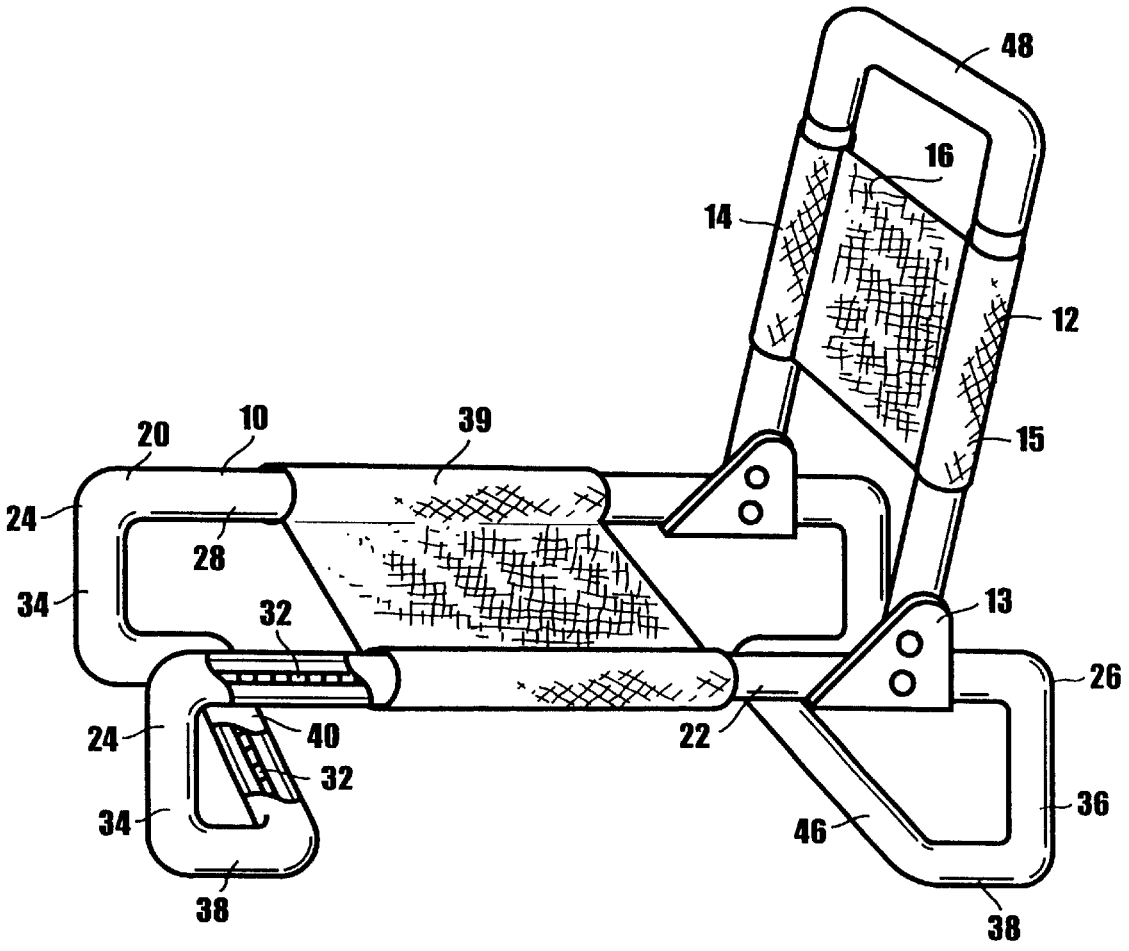
FIG. 1 shows a perspective view of the multipurpose outdoor chair of the invention including a cut-away showing an elastic cord for biasing the side telescoping members together.
Figure 2:
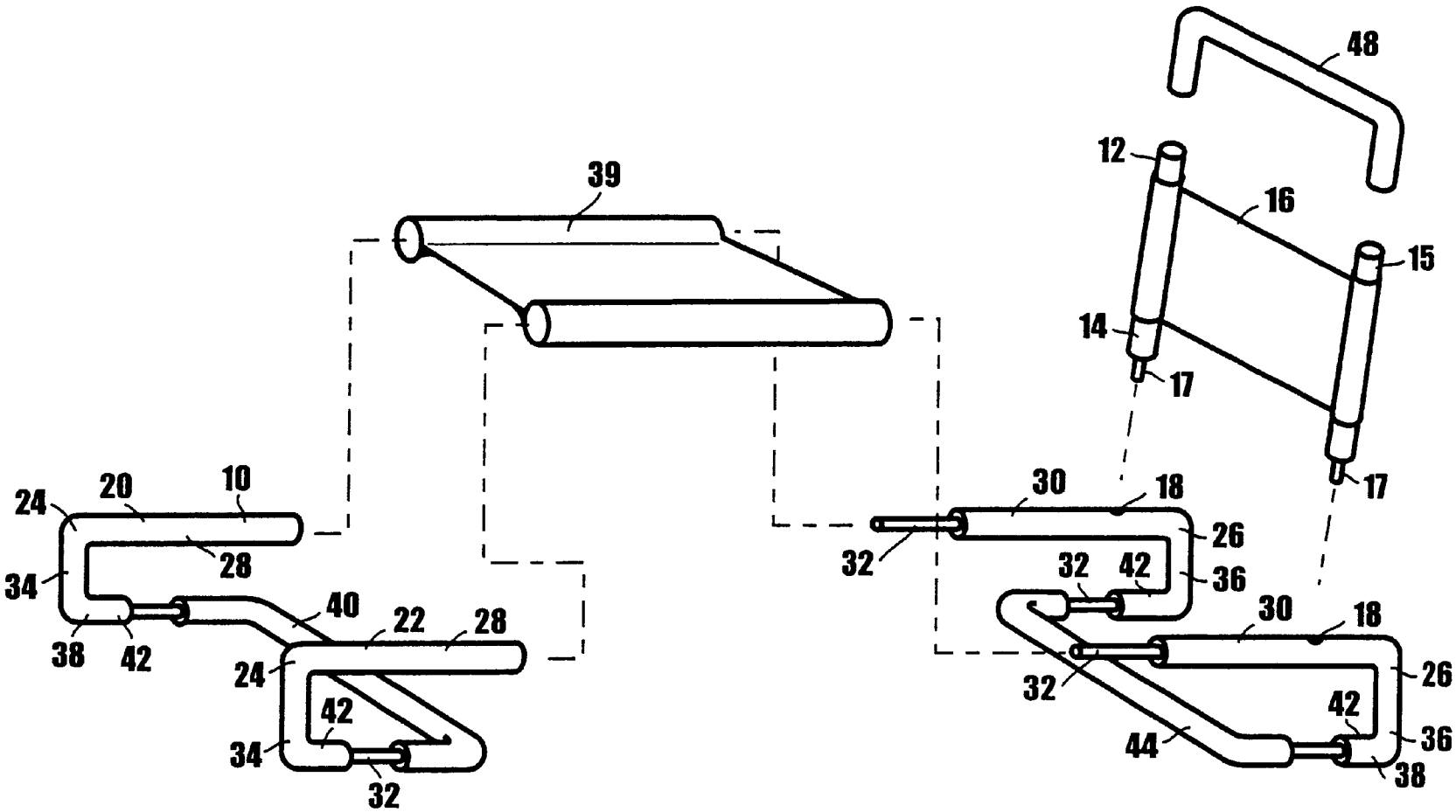
FIG. 2 shows an exploded view of the chair of FIG. 1.

The chair of the present invention includes a seat frame 10 that is connected to a backrest 12 through hinge 13. Alternately, the backrest may be removably attached to the frame by any conventional means, such as by backrest pins 17 extending into frame holes 18, which may extend through the seat frame 10. Typically, the backrest comprises first and second spaced-apart backrest posts 14 and 15 with a back support member 16 attached therebetween. The backrest may also comprise a rigid crosspiece 48 extending from one post to the other post to maintain the frame side members apart during use. So that the seat remains collapsible, the backrest crosspiece is removable from the posts.

The frame includes a left side member 20 and a right side member 22 spaced apart. Each side member is adjustable in length with a front end 24 directed to the seat front and back end 26 directed to a seat rear. Each of the left and right side members are adjustable typically by means of a first adjusting member 28 slidably telescoping from a second adjusting member 30. An elastic cord 32, or equivalently a spring, secured between each adjusting member biases the members toward each other.

A front hook member 34 depends from the front end of the frame left and right side members directed generally rearward. Similarly, a back hook member 36 depends from the back end of the left and the right side members directed generally forward. Thus, the front and back hook members are in opposing disposition adapted to receive a bleacher seat therebetween. Each hook member comprises a lower, horizontal portion 38 directed inward of the seat frame. That is, for the front hook members, the lower portion is directed rearward and for the back hook members, the lower portion is directed forward. Thus, the front and back hook members are in opposing disposition adapted to receive a bleacher seat therebetween. Alternatively, the hook members with horizontal lower portions function as legs with the lower portions serving as expanded pedestals useful for better distributing a user's weight, for example when used on sand or other soft surface.

A seat member 39 is attached between the left and right side members. So that the seat is collapsible, the seat member is typically of nonrigid material, such as a seat web that provides a cushion for the chair user. The backrest 12 is also attached between the left and right side members rearward of the seat member, directed upward from the frame, and is similarly typically of nonrigid material, also so the seat is collapsible. Thus, when not in use, the seat is collapsible as frame side members are folded together.

To maintain the left and right side members apart during use, a front cross member 40 is secured between distal ends 42 of said front hook member lower portions. Likewise, a rear cross member 44 may be secured between distal ends of the back hook member lower portions. The cross members also serve to further distribute a user's weight when used on sand or other soft surface. Typically, the hook members, side members and cross members are tubular, with the cross members fitting removably in the hook member lower portions forming a continuous tubular loop 46. In an alternate embodiment with the frame not intended to be collapsible, the cross members are a fixed to the hook lower portions and a single elastic cord 32 runs continuously in a closed loop within the tubular loop biasing the opposing front and back hook members toward each other.

To use the chair with a bench seat, a pivotably-mounted backrest 2 is rotated upward until the end of the backrest post 12 abuts and stops against the frame 10 at a slightly oblique angle, as shown in FIG. 1. For a removable backrest, the backrest is installed on the seat frame.

The frame telescoping side members are pulled apart against the bias of the elastic cord 32. When the hook members clear the bench, the tubes may be released to allow the elastic cord to bias the first adjusting member 28 into the second adjusting member 30 such that the brackets snugly grasp the front and rear of the bench. The U-shaped nature of the hooks and the elastic member prevent the seat from becoming disengaged from the bench when a user leans back on the backrest or moves about within the chair.

What is claimed is:

1. An adjustable portable chair removably securable to a bleacher bench, comprising:

a frame including a left side member and a right side member spaced apart and adjustable in length, each of the side members having front and back ends and further comprising a first adjusting member telescoping from a second adjusting member, a front hook member depending from the front end of at least one of the left and the right side members and directed generally rearwardly, a back hook member depending from the back end of at least one of the left and the right side members and directed generally forwardly with the front and back hook members in opposing disposition adapted to receive a bleacher bench therebetween, a seat member attached between the left and right side members, a back rest member attached between the left and right side members rearwardly of the seat member and directed forwardly from the frame, a stretchable, resilient member between the first adjusting member and the second adjusting member.

2. An adjustable portable chair removably securable to a bleacher bench, comprising:

a frame including a left side ember and a right side member spaced apart and adjustable in length, each of the side members having front and back ends and further comprising a first adjusting member telescoping from a second adjusting member, a front hook member depending from the front end on the left and the right side members and directed generally rearwardly, a back hook member depending from the back end on the left and the right side members and directed generally forwardly with the front and back hook members in opposing disposition, a seat member attached between the left and right side members, backrest attached between the left and right side members rearwardly of the seat member and directed upwardly from the frame, wherein said front and back hook members are adaptable as chair legs, a front and a rear horizontal cross member between distal ends of said front hook members and a rear horizontal cross member between distal ends of said rear hook members, with the left and right side members and the front and back hook members and the front and rear horizontal cross members forming a continuous loop, the front and rear hook members and the front and rear horizontal cross members adapted as a foot distributing a user's weight when supporting the user and the chair on a soft surface.

3. The chair of claim 2 in which said left and right adjusting members and said front and back hook members are tubular and said front and back cross members are tubular forming a continuous tubular loop, and further comprising a continuous, closed-loop elastic member within the tubular loop biasing the opposing front and back hook members toward each other, the hooks therein in disposition to grasp and secure an object therebetween.

4. The chair of claim 2 wherein said hook members are removably attached respectively to said right and left side members.

5. The chair of claim 2 wherein said backrest is removably attachable between the left and right side members rearward of the seat member and directed upward from the frame.

6. The chair of claim 5 wherein the backrest comprises a pair of posts respectively engaging the frame right and left sides and a back support member secured between said pair posts.

7. The chair of claim 6 wherein said back support is of non rigid material and wherein the backrest further comprises a rigid crosspiece between said posts maintaining said frame side members apart.

8. The chair of claim 7 wherein said crosspiece is removably secured to said posts such that the chair is collapsible with said frame side members folding together.

9. An adjustable portable chair removably securable to a bleacher bench, comprising:

a frame including a left side member and a right side member spaced apart and adjustable in length, each of the side members having front and back ends and further comprising a first adjusting member telescoping from a second adjusting member, a front hook member depending from the front end of at least one of the left and the right side members and directed generally rearwardly, a back hook member depending from the back end of at least one of the left and the right side members and directed generally forwardly with the front and back hook members in opposing disposition adapted to receive a bleacher bench therebetween, a seat member attached the left and right side members, a back rest member attached between the left and right side members rearwardly of the seat member and directed upwardly from the frame, including a plurality of holes in said first adjusting member and at least one hole in said second adjusting member and a locking pin removably insertable in said at lest one hole when aligned with one of said plurality of holes.

10. An adjustable portable chair removably securable to a bleacher bench, comprising:

a frame including a left side member and a right side member spaced apart and adjustable in length, each with front and back ends and of the side members having each further comprising a first adjusting member telescoping from a second adjusting member, a front hook member depending from the front end of each of the left and the right side members and directed generally rearwardly, a back hook member depending from the back end of each of the left and the right side members and directed generally forwardly with the front and back hook members in opposing disposition adapted to receive a bleacher bench therebetween, a seat member attached between the left and right side members, a stretchable, resilient member between the first adjusting member and the second adjusting member, a horizontal member on distal ends of said hook members adapted as a foot suitable for supporting the chair, a front cross member between distal ends of said front hook members, a back cross member between distal ends of said back hook members, in which said left and right adjusting members and said front and back hook members are tubular and said front and back cross members are tubular forming a continuous tubular loop, a backrest attached between the left and right side members rearwardly of the seat member and directed upwardly from the frame comprising a pair of posts respectively engaging the frame right and left sides, a back support member secured between said pair of posts, and a rigid crosspiece between said posts maintaining said posts and frame side members apart.

* * * * *